US009290190B2

(12) United States Patent
Koval

(10) Patent No.: US 9,290,190 B2
(45) Date of Patent: Mar. 22, 2016

(54) SYSTEMS AND METHODS FOR DETERMINING WHETHER A TRANSPORTATION TRACK IS OCCUPIED

(76) Inventor: Jeffrey Koval, Lee's Summit, MO (US)

( * ) Notice: Subject to any disclaimer, the term of this patent is extended or adjusted under 35 U.S.C. 154(b) by 2010 days.

(21) Appl. No.: 12/184,014

(22) Filed: Jul. 31, 2008

(65) Prior Publication Data

US 2010/0025545 A1 Feb. 4, 2010

(51) Int. Cl.
*B61L 1/00* (2006.01)
*B61L 1/18* (2006.01)

(52) U.S. Cl.
CPC ..... *B61L 1/187* (2013.01)

(58) Field of Classification Search
USPC ..... 246/122 R, 124
See application file for complete search history.

(56) References Cited

U.S. PATENT DOCUMENTS 4,581,700 A * 4/1986 Farnham et al. ..... 700/80
4,641,803 A * 2/1987 Brown et al. ..... 246/34 CT
4,878,638 A * 11/1989 Hoelscher et al. ..... 246/34 CT
5,092,544 A * 3/1992 Petit et al. ..... 246/126
5,459,663 A * 10/1995 Franke ..... 701/20
5,720,454 A * 2/1998 Bachetti et al. ..... 246/34 R
6,498,969 B2 * 12/2002 Alacoque et al. ..... 701/19
7,006,012 B2 * 2/2006 Taoka et al. ..... 340/933
7,165,748 B2 * 1/2007 Ebuchi et al. ..... 246/122 R
7,523,893 B2 * 4/2009 Francis et al. ..... 246/34 A
2003/0010872 A1 * 1/2003 Lewin et al. ..... 246/122 R
2006/0060724 A1 * 3/2006 Francis et al. ..... 246/122 R
2006/0076461 A1 * 4/2006 DeRose et al. ..... 246/122 R
2008/0142645 A1 * 6/2008 Tomlinson et al. ..... 246/122 R
2009/0277998 A1 * 11/2009 Kiss et al. ..... 246/122 R
2010/0025545 A1 * 2/2010 Koval ..... 246/107

FOREIGN PATENT DOCUMENTS

EP 1493610 A2 1/2005

* cited by examiner

*Primary Examiner* — Jason C Smith

(57) ABSTRACT

A method for determining whether a defined section of a transportation track is occupied is described. The method includes inducing an audio frequency (AF) signal at a first position on the transportation track and receiving the AF signal at a second position on the transportation track. The defined section of the transportation track is located between the first position and the second position on the transportation track. The method further includes measuring a strength of the AF signal received as a function of time at the second position, and identifying an inflection point of the recorded AF signal strength. The inflection point indicates at least one of a rail vehicle entering the defined section of the transportation track and the rail vehicle exiting the defined section of the transportation track. The method further includes determining an occupancy of the defined section of the transportation track, based on the inflection point.

13 Claims, 4 Drawing Sheets

SYSTEMS AND METHODS FOR DETERMINING WHETHER A TRANSPORTATION TRACK IS OCCUPIED

BACKGROUND OF THE INVENTION

The field of the invention relates generally to railroad operation, and more specifically to determining the occupation of a section of railroad track.

Rail vehicle operators rely on information, such as whether upcoming sections of track are occupied, in order to safely and efficiently operate a rail vehicle. Currently, Direct Current (DC) track circuits and Alternating Current (AC) track circuits are used to detect the presence of rail vehicles within a defined section of track known as a track block. DC track circuits and AC track circuits use a transmitter positioned at a first boundary on a rail and a receiver positioned at a second boundary on the rail. The rail section between the first and second boundaries defines the outer limits of the track block. AC track circuits are further described as either Power Frequency (PF) or Audio Frequency (AF) track circuits based on the frequency of operation. AF track circuits operate at higher frequencies than PF track circuits. For the AF track circuit, a modulated carrier signal is transmitted into the rail at the first boundary and is received at the second boundary. If the modulated carrier signal reaches the second boundary with a signal strength that is above a predetermined level, the track block is determined to be unoccupied. In contrast, the track block is determined to be occupied when the strength of the signal received at the second boundary is below a predetermined level. For example, if a rail vehicle approaches the track block, the vehicle electrically shunts the rail, which reduces the strength of the signal received at the second boundary. A rail vehicle may be referred to as a rolling shunt because of a vehicle's effect on the track circuit.

Unlike DC track circuits, AC track circuits can be used in electrified territories. And unlike the DC and PF track circuits, the AF track circuits do not require the use of insulted rail joints at the track circuit boundaries. However, certain conditions, for example, varying electrical conductance through the ballast between the rails, and/or varying wheel/rail contact resistance, may create inconsistent signal levels at the receiver. Inconsistent signal levels at the receiver may result in an imprecise determination of the track circuit boundary location based on the energy level received from the transmitter. A fixed signal strength threshold is currently used to compensate for these limitations. The fixed signal strength threshold ensures the track circuit indicates the track block is occupied whenever a shunt is placed at either the first boundary, the second boundary, or any location between the two. For example, the fixed threshold may be set to be fifty percent (50%) of the maximum signal level. The maximum signal level occurs when the defined track block and both adjacent track blocks are not occupied. The fixed threshold approach may result in a track circuit signaling that a track block is occupied when no train is present within the track block boundaries. The perceived track circuit boundary definition may be as much as fifty feet or more beyond the physical boundaries of the track block. In other words, as a rail vehicle approaches the track block in question, the track circuit may falsely indicate it is occupied before the shunt actually enters the track block. Such a phenomenon is commonly referred to as pre-shunt phenomenon. The false indication of an occupied track block may also occur as a train is departing the track block in question. Such a phenomenon is referred to as post-shunt phenomenon.

Through technology, rails today provide information to operators through means that may be positioned along side of the rail structure, visible to the train operator (referred to as fixed wayside signals), and some that are delivered to the cab of a train for use by an operator (referred to as in-cab signals). Wayside and in-cab signals provide a train operator with information such as continue/stop instructions and suggested operating speeds. Information provided to the operator via such means are at least potentially based on whether an upcoming track block is occupied or unoccupied. If a rail vehicle approaching a track block creates a pre-shunt condition, the operator of the rail vehicle may be instructed to slow or stop the rail vehicle due to the false determination of track block occupancy. Pre-shunt and post-shunt conditions may reduce the efficiency of railroad operation.

BRIEF DESCRIPTION OF THE INVENTION

In one embodiment, a method for determining whether a defined section of a transportation track is occupied is provided. The transportation track includes at least two rails. The method includes inducing an audio frequency signal at a first position on the transportation track and receiving the audio frequency signal at a second position on the transportation track. The defined section of the transportation track is located between the first position and the second position on the transportation track. The method further includes measuring a strength of the audio frequency signal received at the second position, and identifying an inflection point of the recorded/measured audio frequency signal strength. The inflection point indicates at least one of a rail vehicle entering the defined section of the transportation track and the rail vehicle exiting the defined section of the transportation track. The method further includes determining an occupancy of the defined section of the transportation track, based on the inflection point.

In another embodiment, a system for use in determining an occupation of a section of a transportation track having a first boundary and a second boundary is provided. The system includes a transmitter positioned at the first boundary, the transmitter configured to induce an audio frequency signal to the transportation track. The system also includes a receiver positioned at the second boundary, the receiver configured to measure a strength of the audio frequency signal detected at the second boundary as a function of time. The system further includes a processing device configured to analyze the signal measured at the second boundary to facilitate a determination of the occupation of the section of track between the first boundary and the second boundary by identifying an inflection point of the measured signal strength. The inflection point corresponds to at least one of the section of transportation track becoming occupied and the section of transportation track becoming unoccupied.

In yet another embodiment, an audio frequency track circuit is provided. The audio frequency track circuit includes at least one rail, a transmitter positioned at a first boundary on the at least one rail, a receiver positioned at a second boundary on the at least one rail, and a processing device configured to measure a level of a received signal induced to said at least one rail and to detect an inflection point of the received signal.

DETAILED DESCRIPTION OF THE INVENTION

The following detailed description illustrates the disclosure by way of example and not by way of limitation. The description should enable one skilled in the art to make and use the disclosure, describes several embodiments, adaptations, variations, alternatives, and uses of the disclosure, including what is presently believed to be the best mode of carrying out the disclosure. The disclosure is described as applied to exemplary embodiments, namely, systems and methods for detecting the presence of a rail vehicle. However, it is contemplated that this disclosure has general application to vehicle control and detection systems in industrial, commercial, and residential applications.

Figure 1:
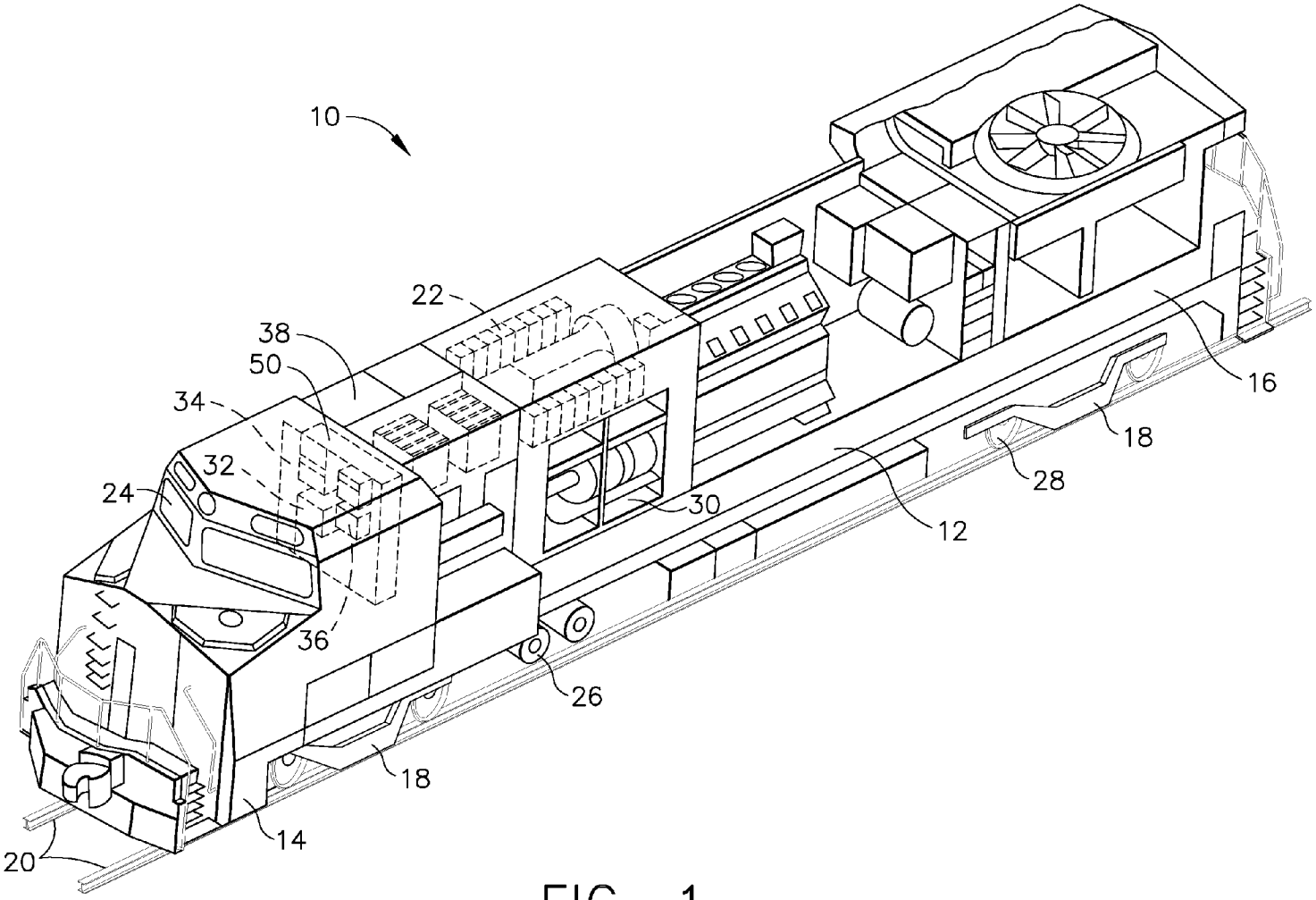
FIG. 1 is a partial cut away view of an exemplary rail vehicle.

FIG. 1 is a partial cut away view of an exemplary rail vehicle, which may also be referred to as an Off-Highway Vehicle (OHV). In the exemplary embodiment, the OHV is a locomotive 10. Locomotive 10 includes a platform 12 having a first end 14 and a second end 16. A propulsion system 18, or truck, is coupled to platform 12 for supporting, and propelling platform 12 on a pair of rails 20. An equipment compartment 22 and an operator cab 24 are coupled to platform 12. In the exemplary embodiment, an air and air brake system 26 provides compressed air to locomotive 10, which uses the compressed air to actuate a plurality of air brakes 28 on locomotive 10 and railcars (not shown) behind it. An auxiliary alternator system 30 supplies power to all auxiliary equipment and is also utilized to recharge one or more on-board power sources. An intra-consist communications system 32 collects, distributes, and displays consist data across all locomotives in a consist.

A cab signal system 34 links the wayside (not shown) to a train control system 36. In particular, system 34 receives coded signals from a pair of rails 20 through track receivers (not shown) located on the front and rear of the locomotive. The information received is used to inform the locomotive operator of the speed limit and operating mode. A distributed power control system 38 enables remote control capability of multiple locomotive consists coupled in the train. System 38 also provides for control of tractive power in motoring and braking, as well as air brake control.

Locomotive 10 systems are monitored and/or controlled by a train control system 50. Train control system 50 generally includes at least one computer (not shown in FIG. 1) that is programmed to perform the functions described herein. Computer, as used herein, is not limited to just those integrated circuits referred to in the art as a computer, but broadly refers to a processor, a microprocessor, a microcontroller, a programmable logic controller, an application specific integrated circuit, and another programmable circuit, and these terms are used interchangeably herein.

Figure 2:
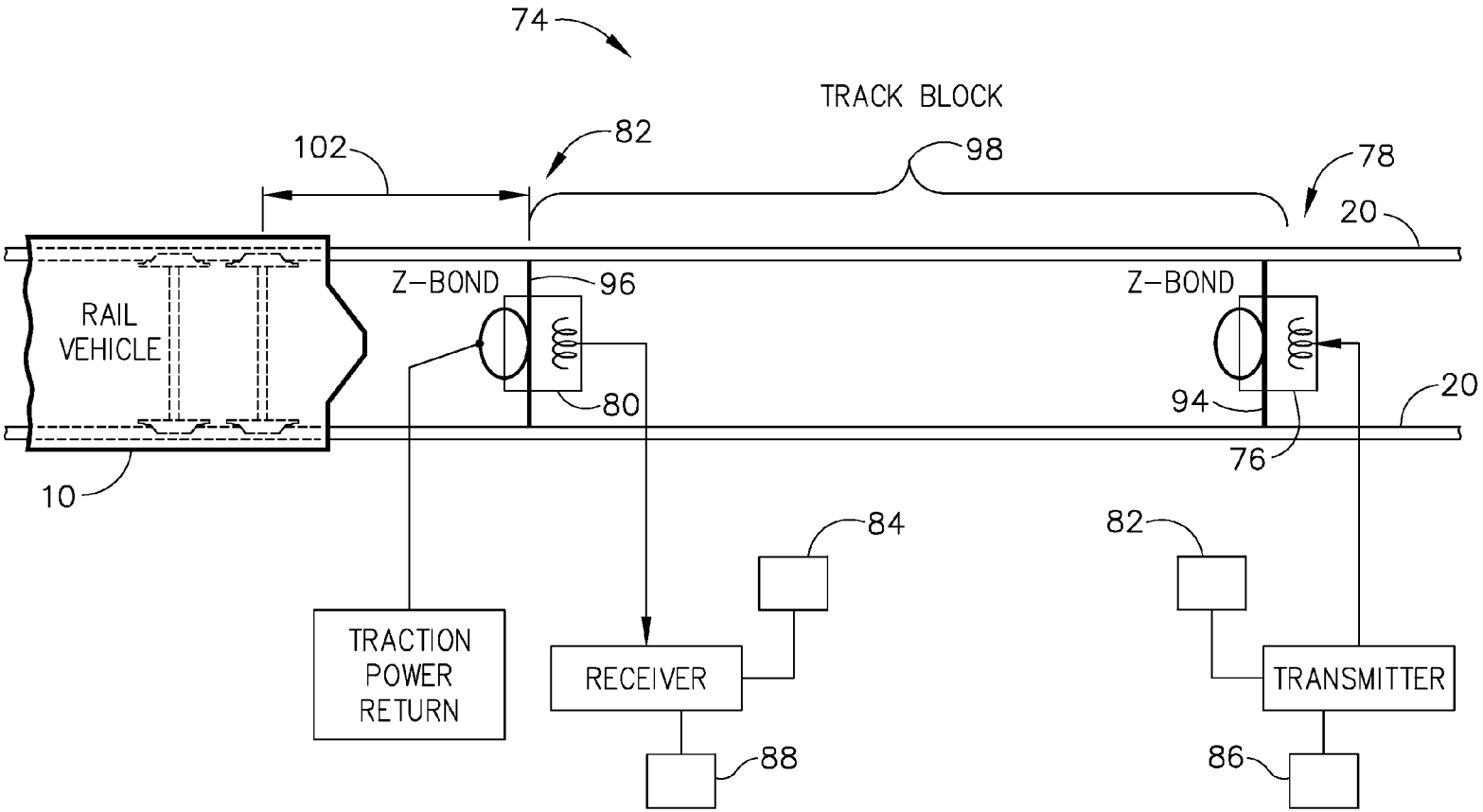
FIG. 2 is a top-view diagram of an exemplary audio frequency track circuit.

FIG. 2 is a diagram illustrating an exemplary track circuit 74. In the exemplary embodiment, track circuit 74 includes a transmitter 76 coupled to at a first track circuit boundary 78 along rails 20 and a receiver 80 positioned at a second track circuit boundary 82 along rails 20. In some embodiments, transmitter 76 and/or receiver 80 are coupled to a processing device 82 and 84. Furthermore, in some embodiments, transmitter 76 is coupled to a memory unit 86 and/or receiver 80 is coupled to a memory unit 88. A first impedance bond 94 is positioned at first track circuit boundary 78 and a second impedance bond 96 is positioned at second track circuit boundary 82. First impedance bond 94 and second impedance bond 96 inductively couple rails 20 to form track circuit 74. Track circuit 74 facilitates a determination of the occupancy of a track block 98. Track block 98 is defined as the section of rails 20 extending between first track circuit boundary 78 and second track circuit boundary 82. As used herein, when any portion of a rail vehicle 10 is between first track circuit boundary 78 and second track circuit boundary 82, track block 98 is occupied. Furthermore, when a rail vehicle 10 crosses either first track circuit boundary 78 or second track circuit boundary 82 to occupy a previously unoccupied track block 98, the rail vehicle is referred to as entering track block 98. Conversely, when a rail vehicle crosses either first track circuit boundary 78 or second track circuit boundary 82, leaving a previously occupied track block 98, unoccupied, the rail vehicle is referred to as exiting track block 98. For example, in FIG. 2, rail vehicle 10 is positioned outside of, or exterior to, track block 98.

Transmitter 76 transmits a carrier signal (not shown in FIG. 2) at first track circuit boundary 78 into either or both rails 20. Receiver 80 receives the carrier signal at second track circuit boundary 82. In the exemplary embodiment, the carrier signal is a modulated audio frequency carrier signal. Alternatively, any carrier signal may be used that enables track circuit 74 to function as described herein. When sufficient energy from transmitter 76 is received and demodulated by receiver 80, track block 98 is determined to not be occupied by a rail vehicle, for example, locomotive 10. As locomotive 10 approaches track block 98, rail vehicle 10 electrically shunts rails 20, reducing the energy received at receiver 80. Track block 98 is determined to be occupied when receiver 80 detects that the energy or current passing through second inductive bond 96 is sufficiently reduced as compared to an unoccupied track block.

Figure 3:
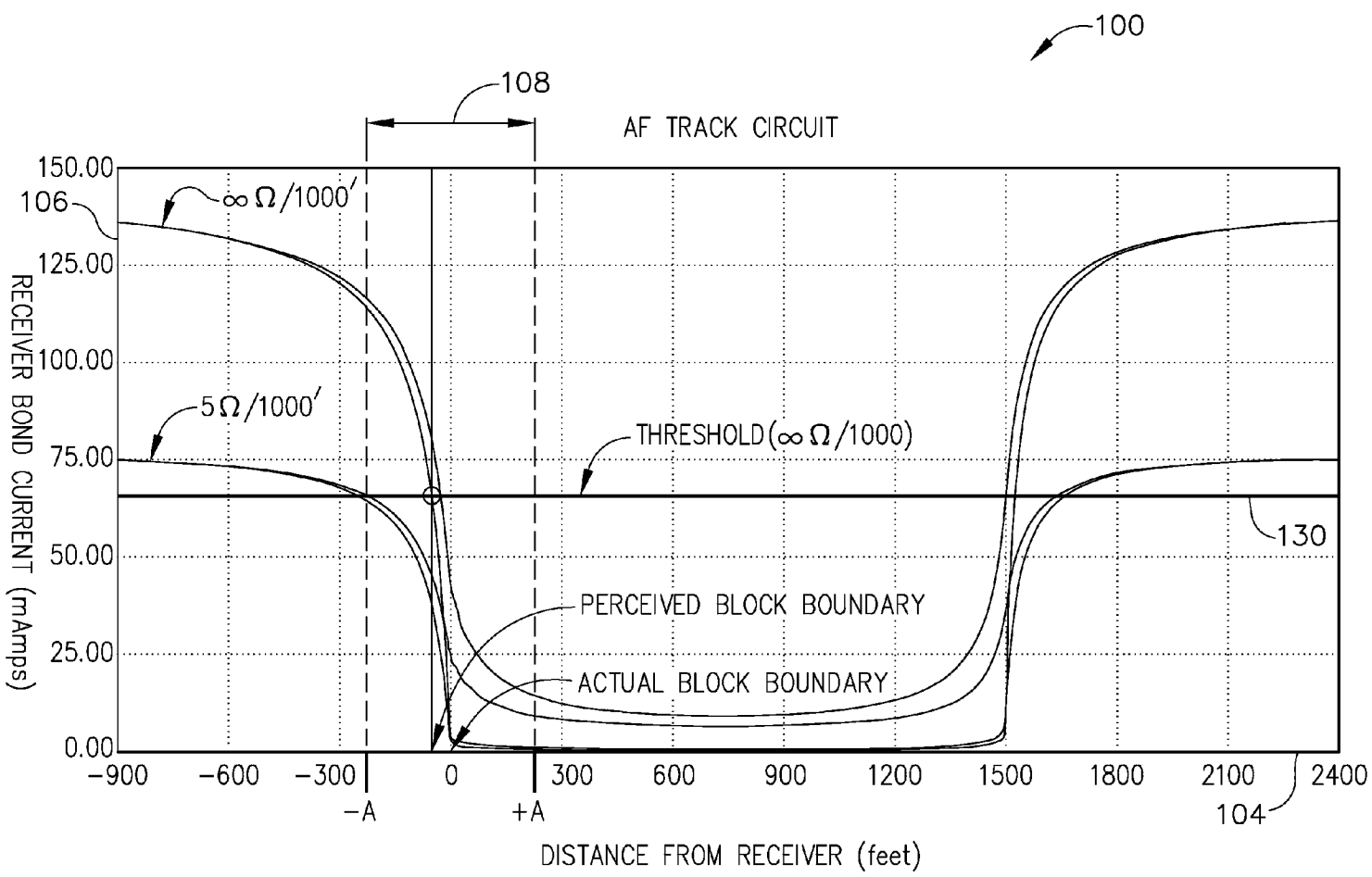
FIG. 3 is a graph that illustrates an exemplary signal strength detected at a receiver as a rail vehicle approaches, passes through, and exits a track block.
Figure 4:
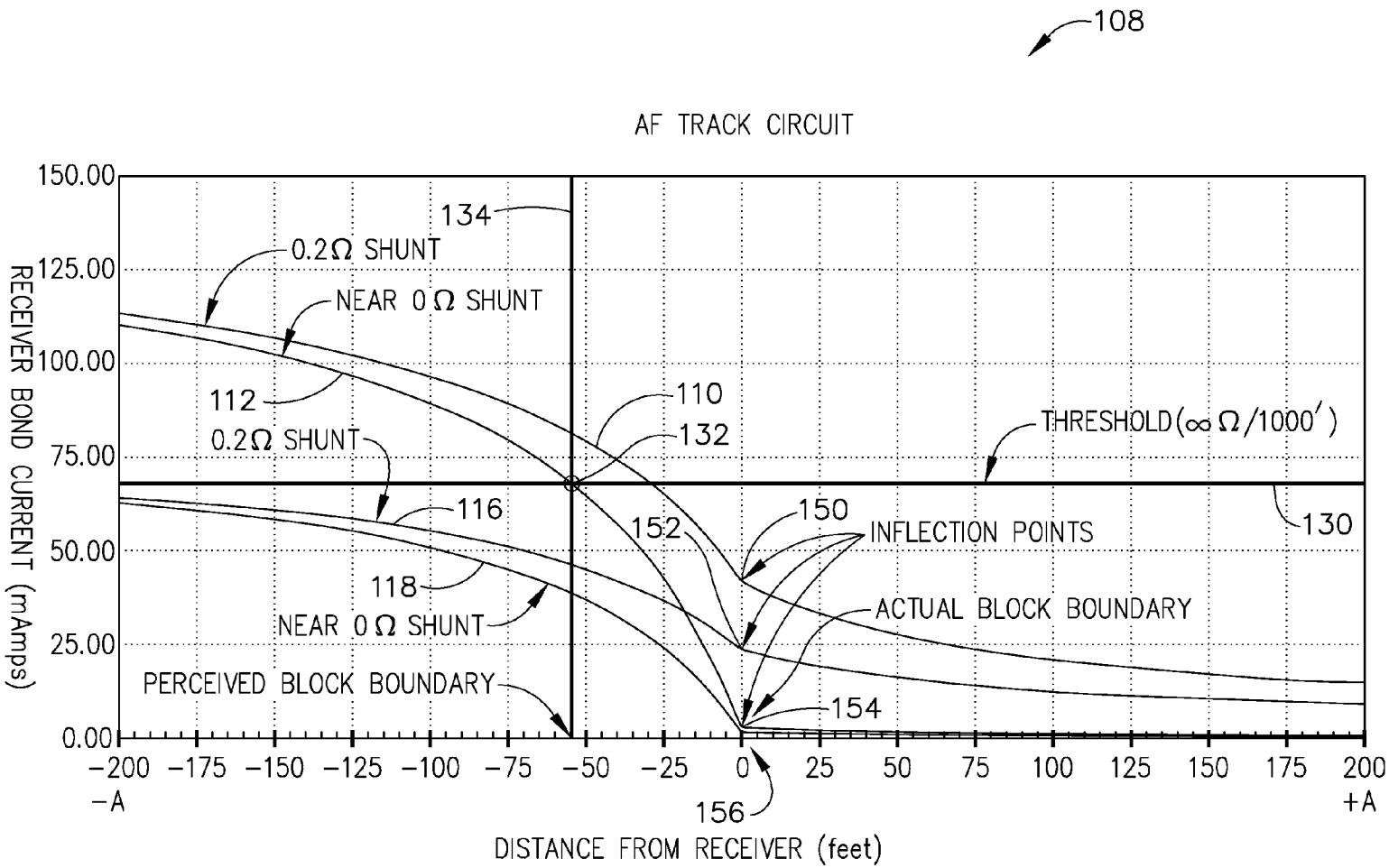
FIG. 4 is an enlarged portion of the graph of FIG. 3, illustrating the signal strength detected at the receiver as a rail vehicle enters the track block.

FIG. 3 is a graph 100 that illustrates an exemplary signal strength detected at receiver 80 (shown in FIG. 2) as a rail vehicle approaches, passes through, and exits track block 98. A distance 102 (shown in FIG. 2) rail vehicle 10 is from second circuit boundary 82 (shown in FIG. 2) is plotted along an X-axis 104 and a signal strength detected at receiver 80 (shown in FIG. 2) is plotted along a Y-axis 106. Graph 100 may also illustrate a signal strength detected at receiver 80 (shown in FIG. 2) as rail vehicle 10 approaches and enters track block 98 by crossing first circuit boundary 78 (shown in FIG. 2) In the exemplary embodiment, the signal strength is measured in milliamperes. FIG. 4 is an enlarged portion 108 of graph 100 from reference points −A to +A identified on X-axis 104.

In the exemplary embodiment, four received signals 110, 112, 116, and 118 are illustrated. Each signal 110, 112, 116, and 118 represents a track circuit that includes impedance bonds 94 and 96 at different shunting and rail-to-rail impedance values. More specifically, in the exemplary embodiments, first received signal 110 and second received signal 112 are received by receiver 80 included in a track circuit 74 that has impedance bonds 94 and 96 that have an ideal rail-to-rail impedance that approaches infinity ohms/one-thousand feet. Third received signal 116 and fourth received signal 118 are signals received by receiver 80 included in a track circuit 74 having impedance bonds 94 and 96 that have a rail-to-rail impedance of approximately five ohms/one-thousand feet. Environmental conditions of track circuit 74 may lower the rail-to-rail impedance from approaching infinity ohms/one-thousand feet to a lower rail-to-rail impedance. In FIGS. 3 and 4, zero feet along X-axis 104 corresponds to the position of second circuit boundary 82.

As rail vehicle 10 approaches track block 98, rail vehicle 10 electrically shunts rails 20 of track block 98. This electrical shunt reduces the strength of the signal received by receiver 80. In one embodiment, a track block is determined to be occupied by a rail vehicle when the signal strength received by receiver 80 is below a threshold value 130. However, the accuracy with which a set threshold value facilitates identifying when a rail vehicle enters or exits a track block may be limited due to pre-shunt conditions and post-shunt conditions.

A pre-shunt condition occurs when the presence of rail vehicle 10 reduces the signal strength received at receiver 80 to below a threshold value 130 before rail vehicle 10 passes either first track circuit boundary 78 or second track circuit boundary 82 to enter track block 98. When a pre-shunt condition occurs, track circuit 74 falsely indicates track block 98 is occupied, when no rail vehicle 10 is present within track block 98. An exemplary pre-shunt condition is shown in FIG. 4 at an intersection 132 of threshold 130 and at a distance 134. At intersection 132, the strength of second received signal 112 is reduced to less than threshold 130 as rail vehicle 10 approaches second circuit boundary 82 (shown in FIG. 2). In this embodiment, track circuit 74 determines track block 98 is occupied even though rail vehicle 10 is still approximately fifty-five feet outside of track block 98. Similarly, a post-shunt condition may occur as a rail vehicle exits track block 98. In a post-shunt condition, track block 98 is falsely determined to be occupied even though the rail vehicle has exited track block 98. The effect of pre-shunt and post-shunt conditions may be worsened as the rail-to-rail impedance of track circuit 74 is lowered, for example, as described above with respect to environmental conditions. As shown in FIG. 4, signals 116 and 118 are below threshold 130, indicating track block 98 is occupied, even beyond two-hundred feet from second circuit track boundary 82.

Pre-shunt conditions may lead to undesirable operations. For example, when in-cab signals are employed, a brief loss of in-cab signal energy being received by a rail vehicle may be experienced around track circuit boundaries 78 and 82. The loss of in-cab signal energy may occur when a relatively slow moving rail vehicle approaches a track block boundary and pre-shunts the track block being approached. When this occurs, the cab signal energy being transmitted in the physically occupied block may be discontinued, resulting in a loss of in-cab signal energy being received by the rail vehicle.

Another example of an undesirable effect of pre-shunt conditions occurs when fixed wayside signals are used. If a single joint-less track circuit is used to define the location of a track circuit boundary (i.e., a track circuit that does not include insulated joints), and the wayside signal is positioned at the track circuit boundary, pre-shunt conditions may cause the wayside signal to falsely display an indication that the track block is occupied prior to a rail vehicle reaching the signal. In other words, a pre-shunt condition may cause a fixed wayside signal to indicate the track block is occupied, when in actuality, the approaching rail vehicle itself caused an empty track block to be indicated as being occupied. To compensate for this condition, current applications require the use of double impedance bonds separated by insulated joints at these boundary locations. However, such additional measures increase equipment and maintenance costs.

As described above, the received signal strength of first received signal 110, second received signal 112, third received signal 116, and fourth received signal 118 are plotted over a rail vehicle travel distance and are illustrated in FIG. 4. As shown in FIG. 4, a point of inflection 150, 152, 154, and 156 in each of plot lines 110, 112, 116, and 118 is defined that corresponds to the track circuit boundary location. More specifically, points of inflection 150, 152, 154, and 156 are defined at locations where plot lines 110, 112, 116, and 118 change from concave to convex, or vice versa. Points of inflection 150, 152, 154, and 156 may also be identified at locations where a second derivative of plot lines 110, 112, 116, and 118 changes signs, from positive to negative, or negative to positive.

Points of inflection 150, 152, 154, and 156 are independent of the rail-to-rail conductance or of the shunt resistance. A rate of decrease of the signal level received increases as the rail vehicle approaches track circuit boundary 82. In mathematical terms, a second derivative of each plot 110, 112, 116, and 118 is negative as the rail vehicle approaches track block 98. At the track circuit boundary 82, the rate of decrease of the received signal level is constant, and, in mathematical terms, at the track circuit boundary 82, a second derivative of plot lines 110, 112, 116, and 118 is zero. Once the vehicle is past second track circuit boundary 82, such that the rail vehicle occupies track block 98, the rate of decrease of the received signal level decreases. In mathematical terms, when the rail vehicle occupies track block 98, a second derivative of plot lines 110, 112, 116, and 118 is positive.

In contrast to the threshold method of determining track block occupancy described above, where a rail vehicle corresponding to plot line 110 causes a pre-shunt condition when it is approximately twenty-five feet from second track circuit boundary 82, where a rail vehicle corresponding to plot line 112 causes a pre-shunt condition when approximately fifty-five feet from second track circuit boundary 82, and where rail vehicles corresponding to plot lines 116 and 118 cause a pre-shunt condition when more than two-hundred feet from second track circuit boundary 82, inflection points 150, 152, 154, and 156 all indicate that corresponding rail vehicles enter track block 98 at approximately the same distance. More specifically, points of inflection 150, 152, 154, and 156 correspond to the position of second track circuit boundary 82. In other words, rather than indicating a track block is occupied when a received signal strength is below a fixed threshold, an algorithm is used to detect an inflection point. Once the inflection is detected, the track circuit will indicate the track block is occupied. In the exemplary embodiment, this approach will allow for a reduction of the pre-shunt/post-shunt distance for an AF track circuit, such that the pre-shunt/post-shunt distance approaches zero feet.

Described herein are exemplary methods and systems for determining whether a defined section of a transportation track is occupied. More specifically, the method described herein can be utilized to determine the occupancy of a defined section of transportation track by inducing an audio frequency signal to the transportation track, receiving the signal at a receiver, recording/measuring the strength of the received signal as function of time, and identifying an inflection point of the recorded/measured signal strength. Determination of the occupancy of the defined section of transportation track is based on the identified inflection point.

The systems and methods described herein facilitate efficient and economical identification of transportation track occupancy. Facilitating a reduction in pre-shunt and/or post-shunt conditions may facilitate increased railroad operation efficiency. A technical effect of the methods and systems described herein includes facilitating improved identification of track block occupancy.

Although the systems and methods described and/or illustrated herein are described and/or illustrated with respect to railroads, practice of the systems and methods described and/or illustrated herein is not limited to railroads. Rather, the systems and methods described and/or illustrated herein are applicable to any rail vehicle.

Exemplary embodiments of systems and methods are described and/or illustrated herein in detail. The systems and methods are not limited to the specific embodiments described herein, but rather, components of each system, as well as steps of each method, may be utilized independently and separately from other components and steps described herein. Each component, and each method step, can also be used in combination with other components and/or method steps.

When introducing elements/components/etc. of the assemblies and methods described and/or illustrated herein, the articles "a", "an", "the" and "said" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc.

While the invention has been described in terms of various specific embodiments, those skilled in the art will recognize that the invention can be practiced with modification within the spirit and scope of the claims.

What is claimed is:

1. A system for use in determining an occupation of a section of a transportation track having a first boundary and a second boundary, said system comprising:

a transmitter positioned at the first boundary, said transmitter configured to induce an audio frequency signal to the transportation track;

a receiver positioned at the second boundary, said receiver configured to measure a strength of the audio frequency signal detected at the second boundary;

a processing device coupled to the receiver; and a memory unit configured to store a program, the program comprising at least one code segment that instructs said processing device to identify an inflection point of the measured signal strength, wherein the inflection point corresponds to at least one of the section of transportation track becoming occupied and the section of transportation track becoming unoccupied.

2. A system in accordance with claim 1 wherein the program further comprises at least one code segment that instructs said processing device to record the strength of the audio frequency signal in said memory unit.

3. A system in accordance with claim 2, wherein said processing device is further configured to analyze a plot of the recorded audio frequency signal strength to locate the inflection point of the recorded signal strength.

4. A system in accordance with claim 1 further comprising a first inductance bond coupling a plurality of rails that form the transportation track, said first inductance bond defining the first boundary.

5. A system in accordance with claim 4 further comprising a second inductance bond coupling a plurality of rails that form the transportation track, said second inductance bond defining the second boundary.

6. A system in accordance with claim 1, wherein the program further comprises at least one code segment that instructs said processing device to calculate a second derivative of the measured audio frequency signal strength to locate the inflection point of the measured signal strength.

7. An audio frequency track circuit comprising:

at least one rail;

a transmitter positioned at a first boundary on said at least one rail and configured to induce an audio frequency signal to said at least one rail;

a receiver positioned at a second boundary on said at least one rail and configured to measure a strength of the audio frequency signal detected at the second boundary;

a processing device coupled to said receiver and configured to receive audio frequency signal strengths measured by said receiver over time; and a memory unit configured to store a program, the program comprising at least one code segment that instructs said processing device to detect an inflection point of the audio frequency signal strengths detected at the second boundary.

8. An audio frequency track circuit in accordance with claim 7, wherein the program further comprises at least one code segment that instructs said processing device to record the measured signal strengths of the audio frequency signal detected at the second boundary in said memory unit.

9. An audio frequency track circuit in accordance with claim 8 wherein the program further comprises at least one code segment that instructs said processing device to calculate a second derivative of the measured signal strengths to locate the inflection point.

10. An audio frequency track circuit in accordance with claim 8 wherein the program further comprises at least one code segment that instructs said processing device to analyze a plot of the recorded signal strength received at the second boundary to locate the inflection point of the recorded signal strength.

11. An audio frequency track circuit in accordance with claim 7, wherein said at least one rail comprises a first rail and a second rail.

12. An audio frequency track circuit in accordance with claim 11 further comprising a first inductance bond coupling said first rail to said second rail, said first inductance bond defines the first boundary.

13. An audio frequency track circuit in accordance with claim 12 further comprising a second inductance bond coupling said first rail to said second rail, said second inductance bond defines the second boundary.

* * * * *